US010107060B2

(12) United States Patent
Nguyen

(10) Patent No.: US 10,107,060 B2
(45) **Date of Patent: *Oct. 23, 2018**

(54) METHOD AND SYSTEM FOR TEMPORARILY LOCKING A TUBULAR

(71) Applicant: Cameron International Corporation, Houston, TX (US)

(72) Inventor: Dennis P. Nguyen, Pearland, TX (US)

(73) Assignee: Cameron International Corporation, Houston, TX (US)

( * ) Notice: Subject to any disclaimer, the term of this patent is extended or adjusted under 35 U.S.C. 154(b) by 72 days.

This patent is subject to a terminal disclaimer.

(21) Appl. No.: 15/076,514

(22) Filed: Mar. 21, 2016

(65) Prior Publication Data

US 2017/0016301 A1 Jan. 19, 2017

Related U.S. Application Data

(63) Continuation of application No. 13/130,303, filed as application No. PCT/US2010/020678 on Jan. 11, 2010, now Pat. No. 9,291,022.

(60) Provisional application No. 61/147,991, filed on Jan. 28, 2009.

(51) Int. Cl.
*E21B 33/04* (2006.01)
*E21B 33/06* (2006.01)
(Continued)

(52) U.S. Cl.
CPC ..... *E21B 33/04* (2013.01); *E21B 33/03* (2013.01); *E21B 33/05* (2013.01); *E21B 33/06* (2013.01); *E21B 33/14* (2013.01); *E21B 33/0422* (2013.01)

(58) Field of Classification Search
CPC ..... E21B 33/04; E21B 33/03; E21B 33/05; E21B 33/06; E21B 33/14; E21B 33/0422;
(Continued)

(56) References Cited

U.S. PATENT DOCUMENTS 3,324,951 A 6/1967 Balmer et al.
3,667,547 A 6/1972 Ahlstone
(Continued)

OTHER PUBLICATIONS

PCT International Search Report and Written Opinion; Application No. PCT/US2010/020678; dated May 20, 2010; 15 pages.
(Continued)

*Primary Examiner* — Wei Wang
(74) *Attorney, Agent, or Firm* — Fletcher Yoder, P.C.

(57) ABSTRACT

There is provided a system and method for temporarily locking a wellhead component while cementing it in place within a mineral extraction system. As cement is pumped into the wellhead, its temperature may be increased, leading to thermal expansion of the cement and movement of wellhead components. Disclosed embodiments include a hold-down ring configured to cooperate with tie-down screws to temporarily lock a running tool in place within the wellhead during cementing. In another embodiment, the tie-down screws may cooperate directly with the running tool. The locked running tool then blocks other wellhead components, such as a hanger run into the wellhead by the running tool, from upward axial movement due to thermal expansion of the cement during the cementing process. After the hanger is cemented in place, the running tool may be unlocked and retrieved from the wellhead.

24 Claims, 4 Drawing Sheets

(51) Int. Cl.
*E21B 33/05* (2006.01)
*E21B 33/14* (2006.01)
*E21B 33/03* (2006.01)

(58) Field of Classification Search
CPC .... E21B 33/047; E21B 33/043; E21B 33/068; E21B 33/02; E21B 33/12; E21B 34/02; E21B 23/03; E21B 34/10; E21B 23/01; E21B 33/13
See application file for complete search history.

(56) References Cited

U.S. PATENT DOCUMENTS

| | | | | |
|---|---|---|---|---|
| 4,058,162 | A | 11/1977 | Smith | |
| 4,473,230 | A | 9/1984 | Adamek | |
| 4,476,935 | A | 10/1984 | Hynes et al. | |
| 4,823,871 | A | 4/1989 | McEver | |
| 4,974,676 | A | 12/1990 | Duhn et al. | |
| 5,109,923 | A | 5/1992 | Koleilat | |
| 6,823,938 | B1 * | 11/2004 | Milberger | E21B 23/01 166/208 |
| RE43,773 | E | 10/2012 | Duhn | |
| 2009/0032241 | A1 * | 2/2009 | Allen | E21B 33/03 166/72 |
| 2009/0107685 | A1 | 4/2009 | Cain et al. | |

OTHER PUBLICATIONS

SG Written Opinion; Application No. SG 201104398-1; dated Jul. 17, 2012; 7 pages.

* cited by examiner

METHOD AND SYSTEM FOR TEMPORARILY LOCKING A TUBULAR

CROSS REFERENCE TO RELATED APPLICATIONS

This application claims priority to and benefit of U.S. Non-Provisional patent application Ser. No. 13/130,303, entitled "Method and System for Temporarily Locking a Tubular," filed May 19, 2011, which is herein incorporated by reference in its entirety, and which claims priority to and benefit of PCT Patent Application No. PCT/US2010/020678, entitled "Method and System for Temporarily Locking a Tubular," filed Jan. 11, 2010, which is herein incorporated by reference in its entirety, and which claims priority to and benefit of U.S. Provisional Patent Application No. 61/147,991, entitled "Method and System for Temporarily Locking a Tubular", filed on Jan. 28, 2009, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to a myriad of other uses. Once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as casings, trees, manifolds, and the like, that facilitate drilling and/or extraction operations.

A long pipe, such as a casing, may be lowered into the earth to enable access to the natural resource. Additional pipes and/or tubes may then be run through the casing to facilitate extraction of the resource. In some instances, it may be desirable to cement a wellhead component in place within another component to disable movement of the components under very high pressures. As cement is pumped into the wellhead, it may be heated up by the high temperatures found underground. The increased temperatures may cause the cement to expand within the wellhead, which may result in movement of wellhead components. Accordingly, it may be desirable to provide a locking mechanism by which one wellhead component (e.g., a hanger) may be held in place within another component (e.g., a casing) during the cementing process.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present technique include a system and method that addresses one or more of the above-mentioned challenges of cementing wellhead components in place within a mineral extraction system. As explained in greater detail below, the disclosed embodiments include a hold-down ring configured to cooperate with tie-down screws to temporarily lock a running tool in place within the wellhead during cementing. In another embodiment, the tie-down screws may cooperate directly with the running tool. The locked running tool then blocks other wellhead components, such as a hanger run into the wellhead by the running tool, from upward axial movement due to thermal expansion of the cement during the cementing process. After the hanger is cemented in place, the running tool may be unlocked and retrieved from the wellhead.

Figure 1:
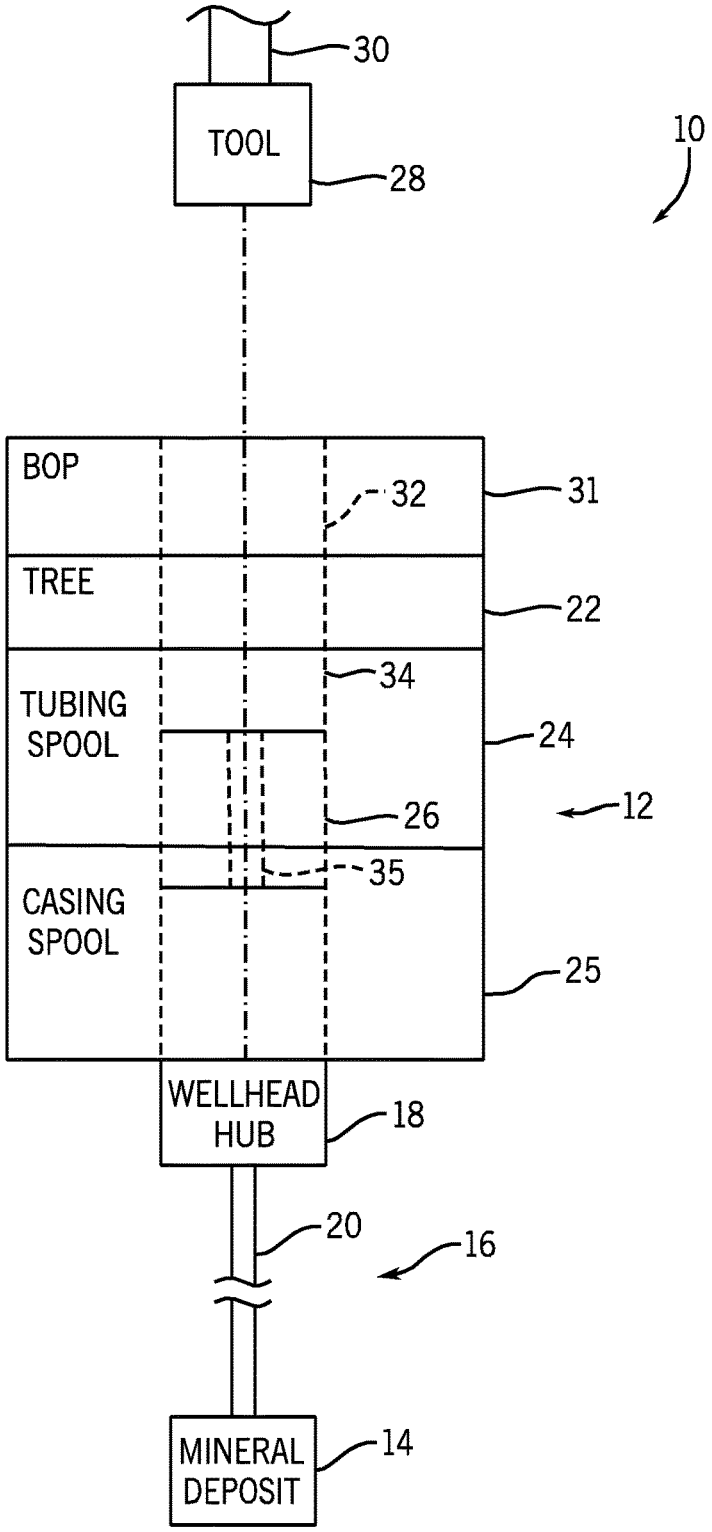
FIG. 1 is a block diagram illustrating a mineral extraction system in accordance with an embodiment of the present invention.

FIG. 1 is a block diagram that illustrates an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or subsea (e.g., a subsea system). As illustrated, the system 10 includes a wellhead 12 coupled to a mineral deposit 14 via a well 16. The well 16 may include a wellhead hub 18 and a well bore 20. The wellhead hub 18 generally includes a large diameter hub disposed at the termination of the well bore 20 and designed to connect the wellhead 12 to the well 16.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore 20. In the illustrated embodiment, the wellhead 12 includes what is colloquially referred to as a Christmas tree 22 (hereinafter, a tree), a tubing spool 24, a casing spool 25, and a hanger 26 (e.g., a tubing hanger and/or a casing hanger). The system 10 may include other devices that are coupled to the wellhead 12, and devices that are used to assemble and control various components of the wellhead 12. For example, in the illustrated embodiment, the system 10 includes a tool 28 suspended from a drill string 30. In certain embodiments, the tool 28 includes a running tool that is lowered (e.g., run) from an offshore vessel to the well 16 and/or the wellhead 12. In other embodiments, such as surface systems, the tool 28 may include a device suspended over and/or lowered into the wellhead 12 via a crane or other supporting device.

The tree 22 generally includes a variety of flow paths (e.g., bores), valves, fittings, and controls for operating the well 16. For instance, the tree 22 may include a frame that is disposed about a tree body, a flow-loop, actuators, and valves. Further, the tree 22 may provide fluid communication with the well 16. For example, the tree 22 includes a tree bore 32. The tree bore 32 provides for completion and workover procedures, such as the insertion of tools into the well 16, the injection of various chemicals into the well 16, and so forth. Further, minerals extracted from the well 16 (e.g., oil and natural gas) may be regulated and routed via the tree 22. For instance, the tree 12 may be coupled to a jumper or a flowline that is tied back to other components, such as a manifold. Accordingly, produced minerals flow from the well 16 to the manifold via the wellhead 12 and/or the tree 22 before being routed to shipping or storage facilities. A blowout preventer (BOP) adapter 31 may also be included, either as a part of the tree 22 or as a separate device. The BOP adapter 31 may consist of a variety of valves, fittings, and controls to prevent oil, gas, or other fluid from exiting the well in the event of an unintentional release of pressure or an overpressure condition.

The tubing spool 24 provides a base for the tree 22. Typically, the tubing spool 24 is one of many components in a modular subsea or surface mineral extraction system 10 that is run from an offshore vessel or surface system. The tubing spool 24 includes a tubing spool bore 34. The tubing spool bore 34 connects (e.g., enables fluid communication between) the tree bore 32 and the well 16. Thus, the tubing spool bore 34 may provide access to the well bore 20 for various completion and workover procedures. For example, components can be run down to the wellhead 12 and disposed in the tubing spool bore 34 to seal off the well bore 20, to inject chemicals down-hole, to suspend tools down-hole, to retrieve tools down-hole, and so forth.

As will be appreciated, the well bore 20 may contain elevated pressures. For example, the well bore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 26 (e.g., tubing hanger or casing hanger) is typically disposed within the wellhead 12 to secure tubing and casing suspended in the well bore 20, and to provide a path for hydraulic control fluid, chemical injections, and so forth. The hanger 26 includes a hanger bore 35 that extends through the center of the hanger 26, and that is in fluid communication with the tubing spool bore 34 and the well bore 20. One or more seals, such as metal-to-metal seals, may be disposed between the hanger 26 and the tubing spool 24 and/or the casing spool 25.

Figure 2:
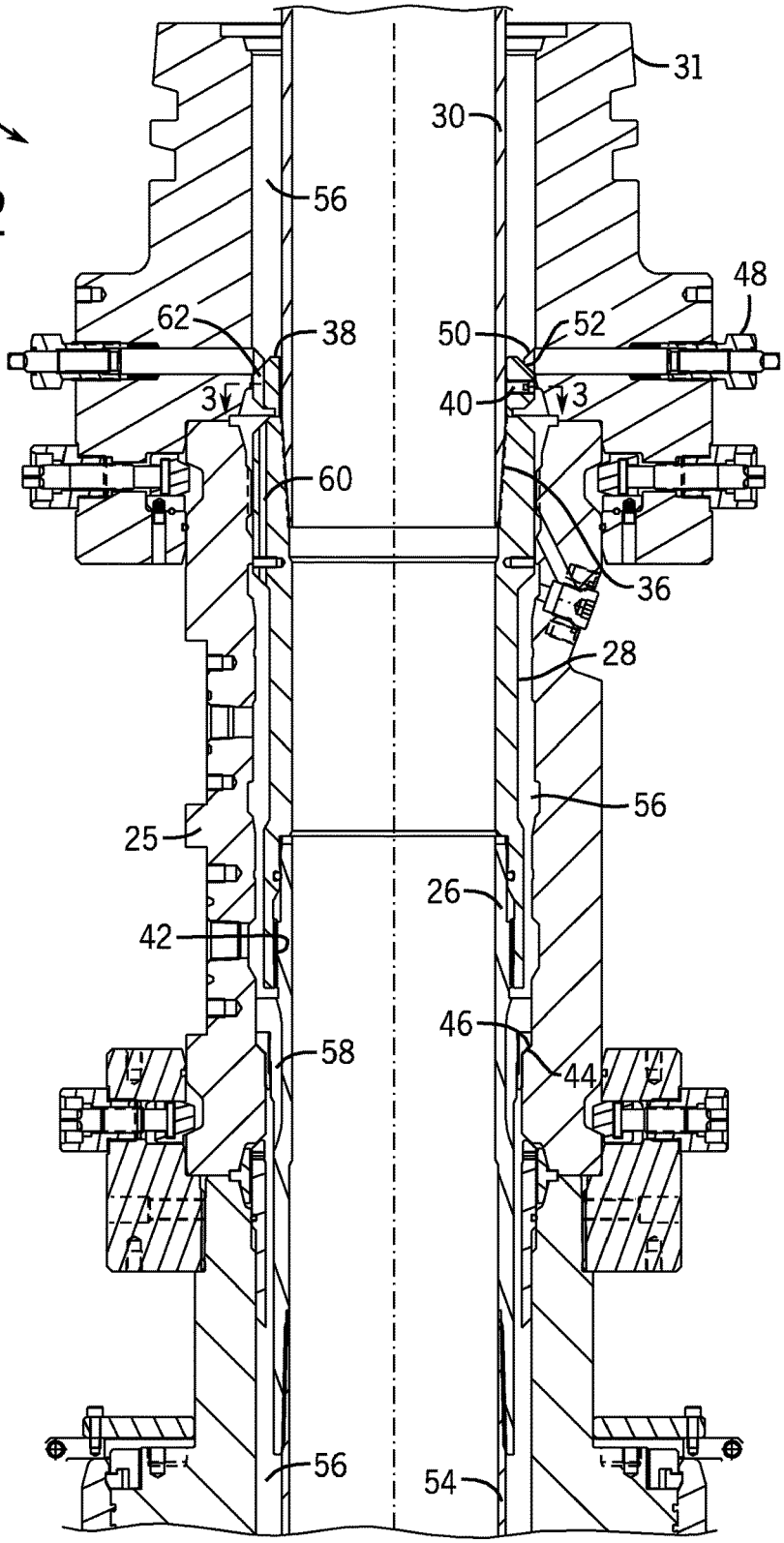
FIG. 2 is a cross-sectional view of exemplary wellhead components in accordance with an embodiment of the present invention.

FIG. 2 illustrates exemplary embodiments of the casing spool 25, the hanger 26, the running tool 28, the drill string 30, and the BOP adapter 31. As illustrated, the drill string 30 is coupled to the running tool 28, for example, via threading 36. A hold-down ring 38 may be disposed around the drill string 30 and above the running tool 28, as described in more detail below. In addition, a set screw 40 may block movement of the hold-down ring 36 relative to the drill string 30. The casing hanger 26 is also coupled to the running tool 28, for example, via threading 42. The casing hanger 26 and the running tool 28 are lowered into the wellhead 12 by the drill string 30. In the illustrated embodiment, the wellhead components may be lowered through the BOP adapter 31 into the casing spool 25 until a landing shoulder 44 on the casing hanger 26 lands on a matching shoulder 46 of the casing spool 25.

After the casing hanger 26 has been properly landed in the casing spool 25, the running tool 28 may be locked in place within the casing hanger 25 and/or the BOP adapter 31. That is, a tie-down screw 48 or similar device may be advanced into the wellhead 12 at a location which enables cooperation with the hold-down ring 38. In the illustrated embodiment, the tie-down screw 48 may be situated within the BOP adapter 31. When the casing hanger 26 has been properly landed, the tie-down screw 48 may be advanced into the wellhead. A tapered end 50 of the tie-down screw 48 may engage an energizing taper 52 on the hold-down ring 38 such that inward radial movement of the tie-down screw 48 results in axial downward movement or compression of the hold-down ring 38. By securing one or more such tie-down screws 48, the hold-down ring 38 may be blocked from axial upward movement, even under great pressure (e.g., due to thermal expansion of cement downhole). The hold-down ring 38, in turn, blocks axial upward movement of the running tool 28 and the casing hanger 26 disposed below the ring 38 within the wellhead 12.

With the tie-down screws 48 engaging the hold-down ring 38, the casing hanger 26 may be temporarily locked in place within the wellhead 12. That is, the landing shoulder 44 and matching shoulder 46 in the casing spool 25 may block downward axial movement of the casing hanger 26, while the tie-down screws 48 block upward axial movement. While the casing hanger 26 is in this locked state, it may be cemented in place within the casing spool 25. That is, cement may be passed through bores in the drill string 30, the running tool 28, the casing hanger 26, and a casing 54. At a cementing valve (not shown), the cement may be allowed to exit the casing 54 and flow back up the wellhead 12 via an annular space 56 between the internal components and the surrounding components. The internal wellhead components may include features to facilitate the upward flow of cement through the annular space 56. For example, the casing hanger 26 may include one or more flow-through bores 58 to enable cement to flow past the abutting shoulders 44 and 46. The flow-through bores 58 may be generally axial holes in the wall of the casing hanger 26, with openings to the annular space 56 both axially above and below the abutting shoulders 44 and 46 to enable fluid flow therethrough. Likewise, the running tool 28 and the hold-down ring 38 may include flow-through bores 60 and 62, respectively.

Figure 3:
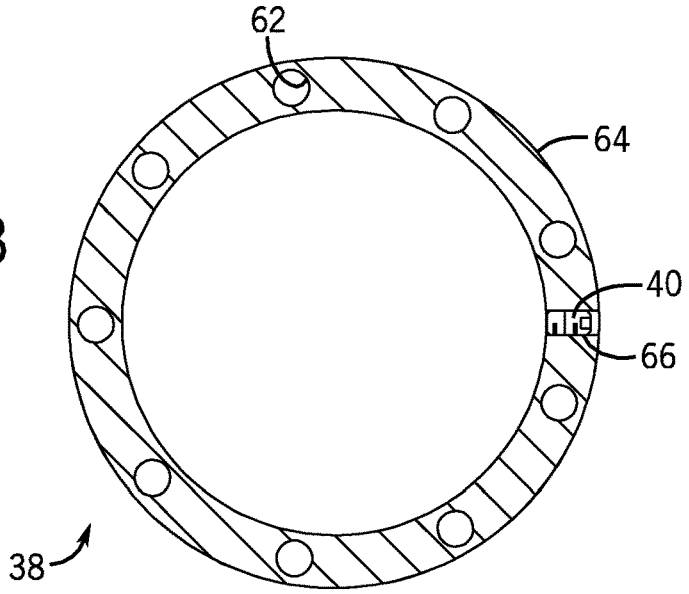
FIG. 3 is a cross-sectional view of a hold-down ring of FIG. 2 taken along a line 3-3 in accordance with an embodiment of the present invention.

A cross-sectional view of an exemplary embodiment of the hold-down ring 38 is illustrated in FIG. 3. As shown, the flow-through bores 62 may enable fluid flow through a wall 64 of the hold-down ring 38. In addition, the set screw 40 may be disposed radially through the hold-down ring 38 within a threaded bore 66. When the hold-down ring 38 is disposed about the drill string 30, inward radial movement of the set screw 40 may secure the hold-down ring 38 in place relative to the drill string 30. A benefit of using the hold-down ring 38 is that the temporary locking method may be implemented using existing equipment. That is, the hold-down ring 38 may simply be added to an existing drill string 30 above the running tool 28. The hold-down ring 38 may be sized based on an existing BOP adapter 31 having tie-down screws 48. In another embodiment, the tie-down screws 48 may be disposed within a tubing spool, casing spool, housing, or other wellhead component designed to be in alignment with the hold-down ring 38 during the cementing process.

Figure 4:
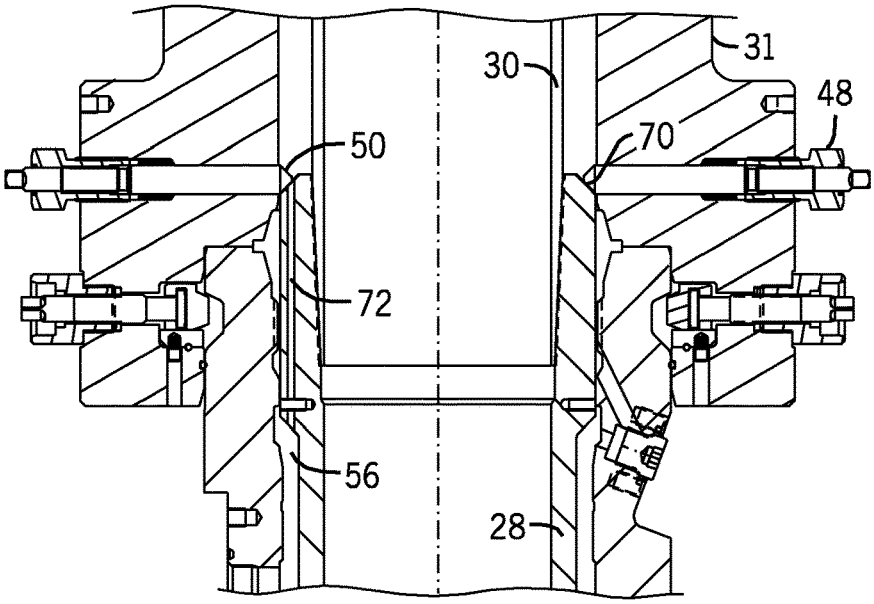
FIG. 4 is a cross-sectional view of exemplary wellhead components in accordance with another embodiment of the present invention.

FIG. 4 illustrates another exemplary embodiment of the running tool 28. In the illustrated embodiment, the running tool 28 may include an energizing taper 70 configured to cooperate with the tapered end 50 of the tie-down screws 48, and the hold-down ring 38 may be omitted. Again, the running tool 28 may include one or more flow-through bores 72 to enable cement to flow through a wall of the running tool 28. A new running tool 28 may be used to implement the embodiment illustrated in FIG. 4; however, an existing drill string 30, BOP adapter 31, casing hanger 26, and other wellhead components may be utilized.

Figure 5:
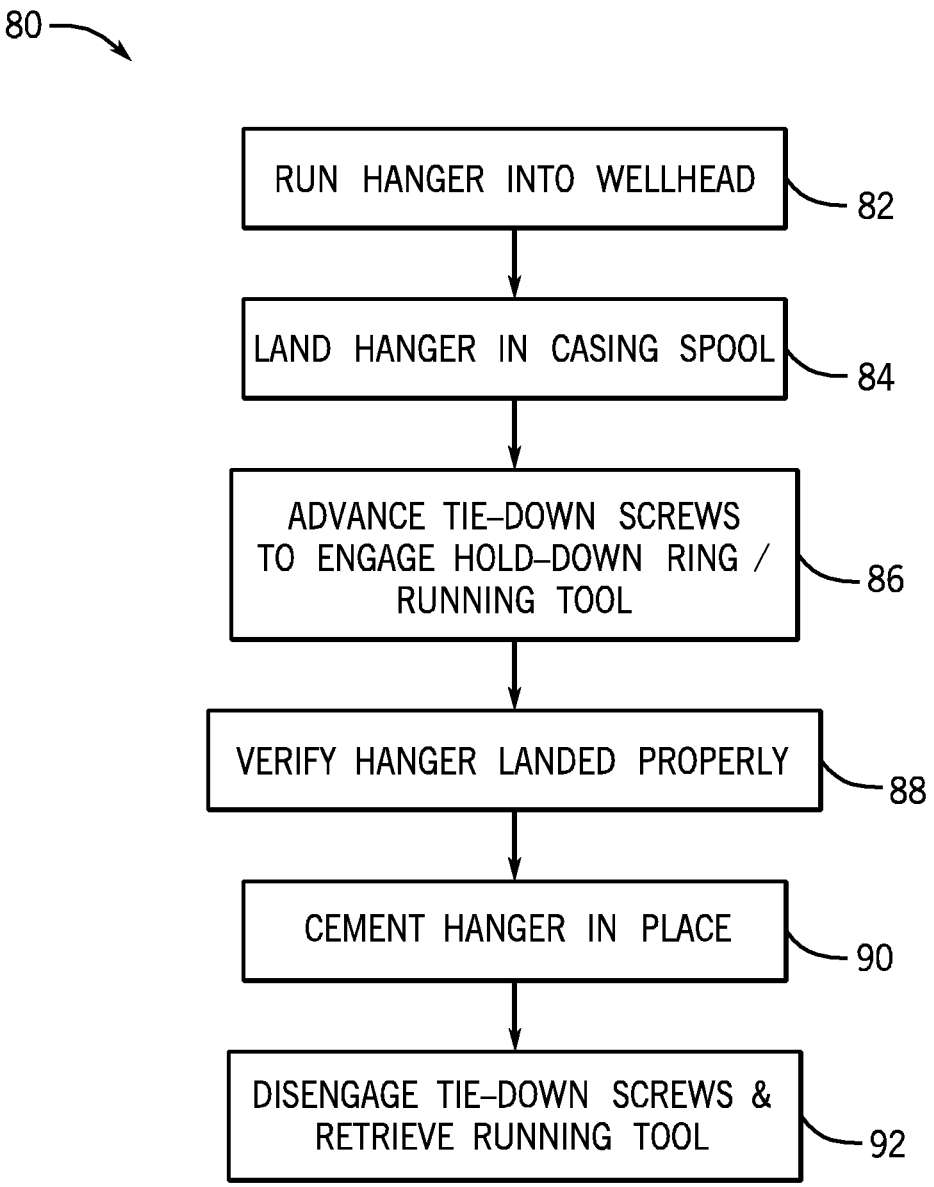
FIG. 5 is a flow chart of an exemplary method in accordance with embodiments of the present invention.

A flow chart 80, illustrated in FIG. 5, illustrates an exemplary method for temporarily locking the hanger 26 in place for cementing. The hanger 26 may be run into the wellhead 12 via the running tool 28 and the drill string 30 (block 82). Advancement of the hanger 26 into the wellhead 12 may stop when the landing shoulder 44 on the hanger 26 lands on the matching shoulder 46 in the casing spool 25 (block 84). After the hanger 26 has been properly landed, the tie-down screws 36 may be advanced radially inward to engage the hold-down ring 38 or the running tool 28 (block 86). In some embodiments, it may be possible to verify that the hanger 26 was landed properly based on the distance the tie-down screws 36 are able to be advanced (block 88). That is, the distance that the tie-down screws 36 are advanced radially inward may be measured, and the measurement may be indicative of the position of the hold-down ring 38 within the wellhead 12 (e.g., if the tie-down screws 36 are not able to be advanced the expected distance, they may be encountering a portion of the hold-down ring 38 or the running tool 28 with a larger diameter rather than the energizing taper 52 (FIG. 2) or 70 (FIG. 4)). While the tie-down screws 36 engage the hold-down ring 38 or the running tool 28, cement may be pumped into the wellhead 12 via the drill string 30 (block 90). The tie-down screws 36 block any upward movement of the hanger 26 and running tool 28 due to pressure from thermal expansion of the cement. After the hanger 26 is cemented in place within the casing spool 25, the tie-down screws 38 may be disengaged, and the running tool 28 and drill string 30 may be retrieved from the wellhead 12 (block 92). In the illustrated embodiment, the running tool 28 may be disengaged from the casing hanger 26 by unscrewing the threads 42.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method, comprising:

blocking upward axial movement of a hanger in a bore of a mineral extraction system via an internal lock axially above the hanger; and cementing the hanger in place while the internal lock blocks the upward axial movement, wherein the cementing comprises flowing a cement in contact with and through one or more cement passages in the internal lock.

2. The method of claim 1, wherein the internal lock comprises a hold down ring having the one or more cement passages.

3. The method of claim 2, wherein the internal lock comprises a radial set member, further comprising moving the radial set member in a radial direction to selectively hold and release the hold down ring.

4. The method of claim 3, wherein moving the radial set member comprises rotating the radial set member along threads to cause movement in the radial direction.

5. The method of claim 1, wherein blocking the upward axial movement of the hanger comprises blocking the upward axial movement of a running tool configured to run the hanger in the bore.

6. The method of claim 5, wherein blocking the upward axial movement of the running tool comprises securing the internal lock above a bottom surface of the running tool.

7. The method of claim 1, wherein blocking the upward axial movement of the hanger comprises blocking the upward axial movement of a drill string.

8. The method of claim 7, wherein blocking the upward axial movement of the drill string comprises securing the internal lock about the drill string.

9. The method of claim 1, wherein blocking the upward axial movement of the hanger comprises securing the internal lock in an adapter configured to couple to a tubular of the mineral extraction system.

10. The method of claim 9, wherein the tubular is a casing spool of a wellhead assembly, and the hanger is a casing hanger.

11. The method of claim 9, wherein the adapter comprises a blowout preventer (BOP) adapter.

12. The method of claim 1, comprising:

securing the internal lock prior to the cementing; and releasing the internal lock after the cementing.

13. The method of claim 1, comprising:

running the hanger in the bore with a running tool prior to the cementing; and retrieving the running tool from the bore after the cementing.

14. A method, comprising:

selectively securing an internal lock in a locked position in an adapter configured to couple to a tubular of a wellhead assembly, wherein the locked position of the internal lock is configured to block upward axial movement of a hanger at a position axially above the hanger during a cementing procedure, the internal lock is disposed within a cement passage, and the internal lock comprises one or more cement passages.

15. The method of claim 14, wherein the internal lock comprises a hold down ring having the one or more cement passages.

16. The method of claim 14, wherein selectively securing the internal lock comprises positioning the internal lock above a bottom surface of a running tool configured to run the hanger in the bore.

17. The method of claim 14, comprising positioning the adapter completely above the hanger, and securing the adapter about an outer circumference of the tubular.

18. A system, comprising:

an adapter configured to couple to a tubular of a wellhead assembly, wherein the adapter comprises:

an adapter body; and an internal lock disposed within the adapter body, wherein the internal lock is configured to block upward axial movement of a hanger at a position axially above the hanger during a cementing procedure, the internal lock is disposed within a cement passage, and the internal lock comprises one or more cement passages.

19. The system of claim 18, wherein the internal lock comprises a hold down ring having the one or more cement passages.

20. The system of claim 19, wherein the internal lock comprises a radial set member coupled to the adapter and configured to move in a radial direction to selectively hold and release the hold down ring.

21. The system of claim 18, wherein the adapter comprises a blowout preventer (BOP) adapter.

22. The system of claim 18, wherein the adapter is configured to couple to an outer circumference of the tubular completely above the hanger.

23. The system of claim 18, wherein the internal lock is configured to be positioned above a bottom surface of a running tool configured to run the hanger in a bore of the wellhead assembly.

24. The system of claim 18, wherein the internal lock is configured to be positioned about a drill string.

* * * * *